United States Patent [19]

Regan

[11] Patent Number: 4,491,345

[45] Date of Patent: Jan. 1, 1985

[54] MARINE CONDUCTOR COUPLING

[75] Inventor: Albert M. Regan, Huntington Beach, Calif.

[73] Assignee: Hughes Tool Company, Houston, Tex.

[21] Appl. No.: 290,464

[22] Filed: Aug. 6, 1981

[51] Int. Cl.[3] ..... F16L 35/00

[52] U.S. Cl. ..... 285/18; 285/315; 285/DIG. 21

[58] Field of Search ..... 285/18, DIG. 21, 315, 285/334.2

[56] References Cited

U.S. PATENT DOCUMENTS

| | | | |
|---|---|---|---|
| 3,321,217 | 5/1967 | Ahlstone | 285/18 |
| 3,333,870 | 12/1965 | Watkins . | |
| 3,377,087 | 4/1968 | Samerdyke et al. | 285/334.2 X |
| 3,450,421 | 6/1969 | Harwell | 285/315 X |
| 3,675,713 | 7/1972 | Watkins | 285/18 X |
| 3,719,070 | 3/1973 | Hanes | 285/18 X |
| 3,779,313 | 12/1973 | Regan . | |
| 4,221,408 | 9/1980 | Lochte et al. | 285/DIG. 21 |

*Primary Examiner*—Dave W. Arola
*Attorney, Agent, or Firm*—Robert A. Felsman

[57] ABSTRACT

A marine conductor coupling is shown in use in a subsea well installation for connecting a blowout preventer stack to the subsea well head with the coupling including a one piece body of annular configuration having a mandrel receiving vertical bore aligned to a vertical through bore, a plurality of latching dogs received in a mating plurality of horizontally disposed dog receiving slots extending through the annular side wall of the body normal to and intersecting the mandrel receiving bore, mounting studs for connecting the body directly to the associated blowout preventer stack component, whereby forces tending to separate the connector body from the well head mandrel are transmitted directly through the one piece body of the connector, an actuating ring disposed about the inclined rear faces of the latching dogs for urging the dogs into latching engagement with the mandrel, a knock-out ring having a lost motion connection to and being suspended below the actuating ring to be raised by dog releasing motion of the actuating ring to knock the dogs out of their latching engagement with the mandrel and a plurality of hydraulic piston and cylinder means wherein the pistons and piston rods are fixed in stationary relationship to the connector body and associated hydraulic cylinders move vertically relative thereto under hydraulic pressuring and are connected directly to the actuator ring to move it selectively between latching dog wedging and release positions with an indicator rod protruding through a housing surrounding the actuator ring to indicate visually exteriorly of the housing the position of the actuating ring interiorly of the housing.

9 Claims, 5 Drawing Figures

MARINE CONDUCTOR COUPLING

BACKGROUND OF THE INVENTION

The present invention relates in general to coupling means for connecting conduits in a subsea well installation, and particularly to a coupling suitable for connecting large diameter well conduits such as a marine riser or conductor to a blowout preventer stack, or a blowout preventer stack or christmas tree to the well head.

Drilling operations in subsea well installations are normally conducted through a marine conductor or riser which extends from an overhead platform or floating vessel with the riser or conductor running down through the sea to the well head positioned at the ocean bottom. By virtue of movement of the vessel, or bending movement of the marine riser or conductor, due to ocean currents, there is frequently a very high separation loading placed on the connectors between the marine riser and the well head apparatus. It is therefore a primary object of the present invention to disclose and provide an improved marine conductor coupling suitable for connecting a marine conductor or riser run from a floating vessel or overhead platform to the well head apparatus with the coupling being interposed between the riser and well head associated blowout preventer apparatus, between the blowout preventer apparatus and the well head in drilling operations, between the christmas tree and well head in production operations or between any other subsea conduits where a high loading separation force is anticipated and it is necessary to have a repeated connection and disconnection of the coupling members.

It is a further object of the present invention to provide a marine conductor coupling as in the foregoing object wherein the coupling has a low-profile, is a high-pressure connector faciliating inclusion of a metal-to-metal seal between connected conduits and is able to withstand high separation loading applied to the coupling due to forces tending to pull the connector away from the well head conduit to which it is connected.

SUMMARY OF THE INVENTION

Generally stated the marine conductor coupling of the present invention includes the provision of a connector body having a vertical through bore and a mandrel receiving bore aligned thereto, a metal-to-metal seal at the juncture of said bores, a plurality of latch dog receiving slots extending generally horizontally through an annular side wall of the body normal to and intersecting the mandrel receiving bore, latching means for latching the body to a mandrel inserted in the mandrel receiving bore abutting the metal-to-metal seal ring and includes a plurality of latch dogs, one of which is located in each of said slots and means for mounting the body to a subsea well component such as a blowout preventer stack or marine riser whereby forces tending to separate the blowout preventer stack or riser from the associated well head mandrel tending to defeat the seal are transmitted directly through the dogs, body and mounting means without affecting the seal. More particularly, the marine conductor body is made of a one piece annular configuration with the seal ring mounted within the body where the respective bores merge.

Actuating means are provided for actuating the latching dogs into a mandrel latching position and, generally stated, include an actuating ring having an inclined inner bore face adapted to wedge against similarly inclined rear faces of the latching dogs. Biasing means are provided to normally bias the ring into a dog wedging position. Release of the dogs from such position is facilitated through the use of a knock-out ring suspended beneath the actuating ring by a lost motion connection thereto whereby vertical movement of the actuating ring past a dog release position raises the knock-out ring beneath the dogs to bring mating wedging surfaces into engagement to move the dogs an initial amount, allowing separation movement of the connector from the mandrel to cam the dogs to a full release position. The position of the indicator ring within a surrounding housing mounted to the body is indicated visually exteriorly of the housing by an indicator rod mounted on an upper surface of the actuating ring and protruding through an aperture in the housing.

As particularly contemplated within the present invention, the hydraulic means for moving the actuating ring between dog wedging and dog release positions includes the provision of a plurality of hydraulic cylinder and piston subassemblies wherein the piston rods of the cylinder protrude out both ends of the cylinder and are mounted in fixed, stationary relation to the body with the associated pistons also being thus mounted in fixed stationary relation to the body and its surrounding housing. The cylinders move vertically relative the piston rods and are connected directly to the actuating ring to cause vertical movement of the ring in response to the introduction of hydraulic fluid above or below the stationary pistons within the vertically moving cylinders. The piston rods are thus placed in tension under the loading of the hydraulic pressure applied between the stationary pistons and moving cylinders with hydraulic fluid connecting means between the respective chambers of each of the cylinders above and below the pistons to equalize the hydraulic fluid pressure and thus the actuator ring forces upon the latching dogs. The provision of a greater releasing force on the actuator ring is assured by providing a larger diameter piston rod within the cylinder chamber pressured during dog wedging movement of the actuating ring then the diameter of the piston rod within the chambers pressured during a dog release movement of the actuating ring.

It is submitted that a more complete understanding of the present invention in marine conductor coupling, as well as a recognition of additional objects and advantages therefor will be afforded to those skilled in the art from a consideration of the following detailed description of a preferred exemplary embodiment thereof. Reference will be made to the appended sheets of drawings which will first be briefly described.

DETAILED DESCRIPTION OF AN EXEMPLARY EMBODIMENT

Figure 1:
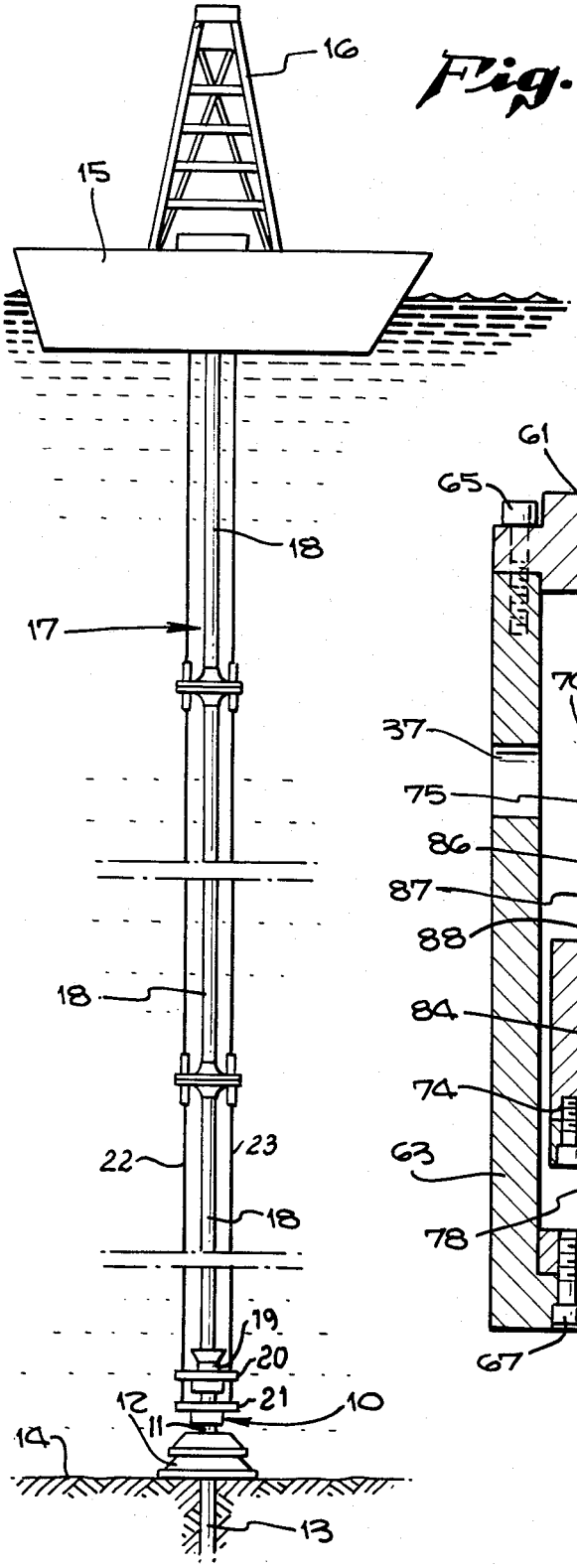
FIG. 1 is an elevational view of an exemplary subsea well installation showing a blowout preventer stack landed on a subsea well head and a marine riser run from an overhead vessel to the blowout preventer stack, an installation in which the marine conductor coupling of the present invention finds particular use.

An exemplary embodiment of the marine conductor coupling of the present invention is illustrated in FIGS. 2 through 5 and is indicated generally at 10 in a typical subsea well head installation in FIG. 1. It is contemplated within the present invention in marine conductor coupling that the coupling will find its most suitable use in connecting a blowout preventer apparatus in a subsea well environment to the well head, or a marine riser run from an overhead vessel to the blowout preventer stack, in a subsea well drilling operation, or to connect the christmas tree to the well head in a subsea well production operation. Referring to FIG. 1, a subsea well drilling installation is generally indicated, somewhat schematically, with the exemplary embodiment of marine conductor coupling of the present invention being indicated generally at 10 connected onto a mandrell 11 at the well head. The well head or mandrel 11 is positioned in template 12 over an exemplary subsea well 13 drilled in the ocean floor 14 with drilling operations being conducted from an overhead floating vessel 15 having a conventional derrick 16. A marine conductor or riser is indicated generally at 17 through which drilling operations are conducted, the riser comprising a plurality of conductor or riser sections 18 connected together and run from the vessel 15 to the blowout preventer stack, indicated generally at 19, the latter being oriented at the well by guide frames 20 and 21 run on a plurality of guide lines, including lines 22 and 23. While the exemplary marine conductor coupling of the present invention is illustrated in FIG. 1 as being located between the blowout preventer 19 and the well head mandrel 11, it could be, as stated before, positioned between the blowout preventer stack 19 and one of the riser conduit sections 18, or elsewhere in the subsea well apparatus were it is desired to connect a conduit to a mandrel member.

Figure 2:
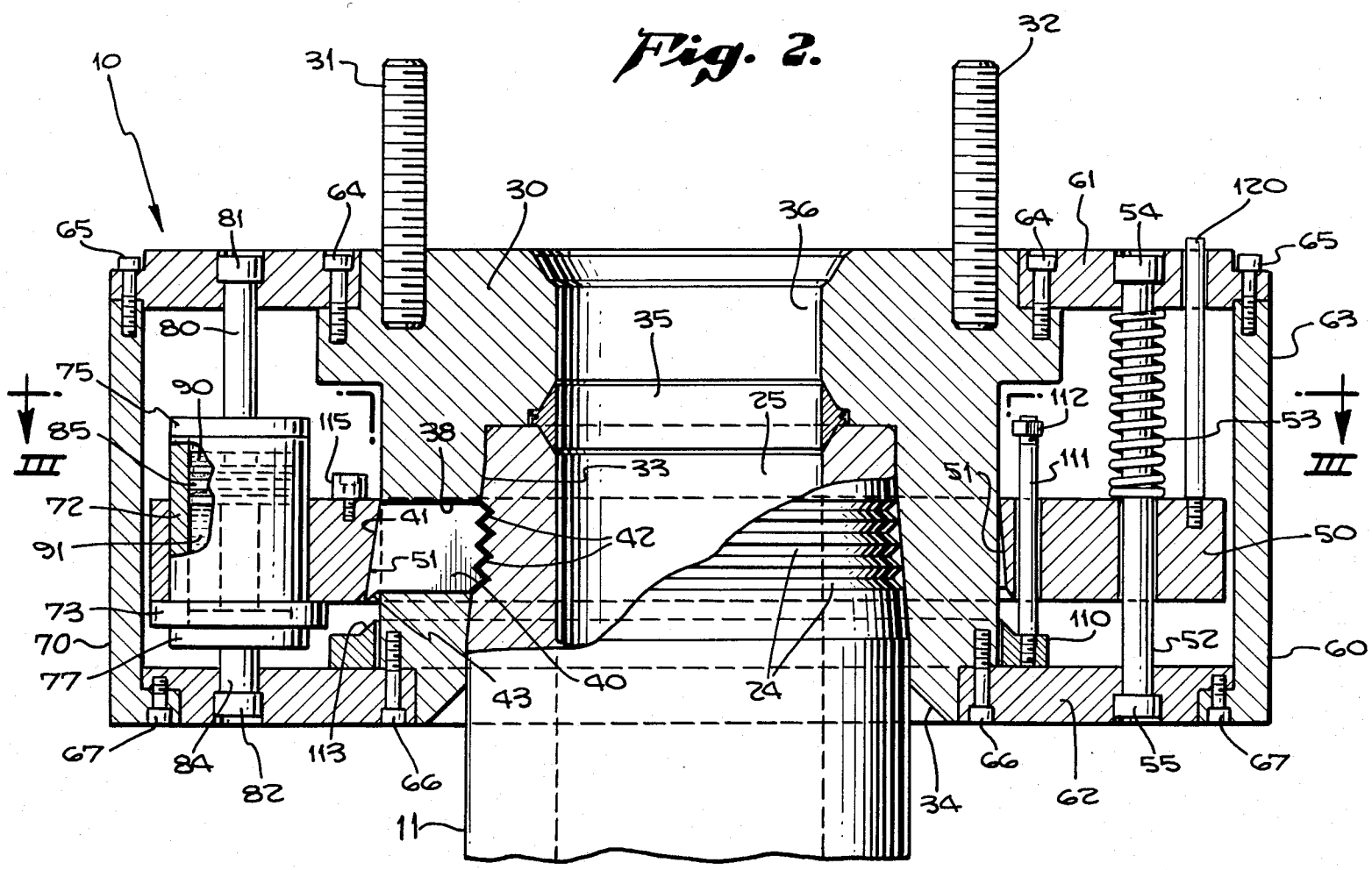
FIG. 2 is a vertical section view of an exemplary embodiment of marine conductor coupling in accordance with the present invention showing the latching dogs and associated hydraulic actuating means in a mandrel latching position.
Figure 3:
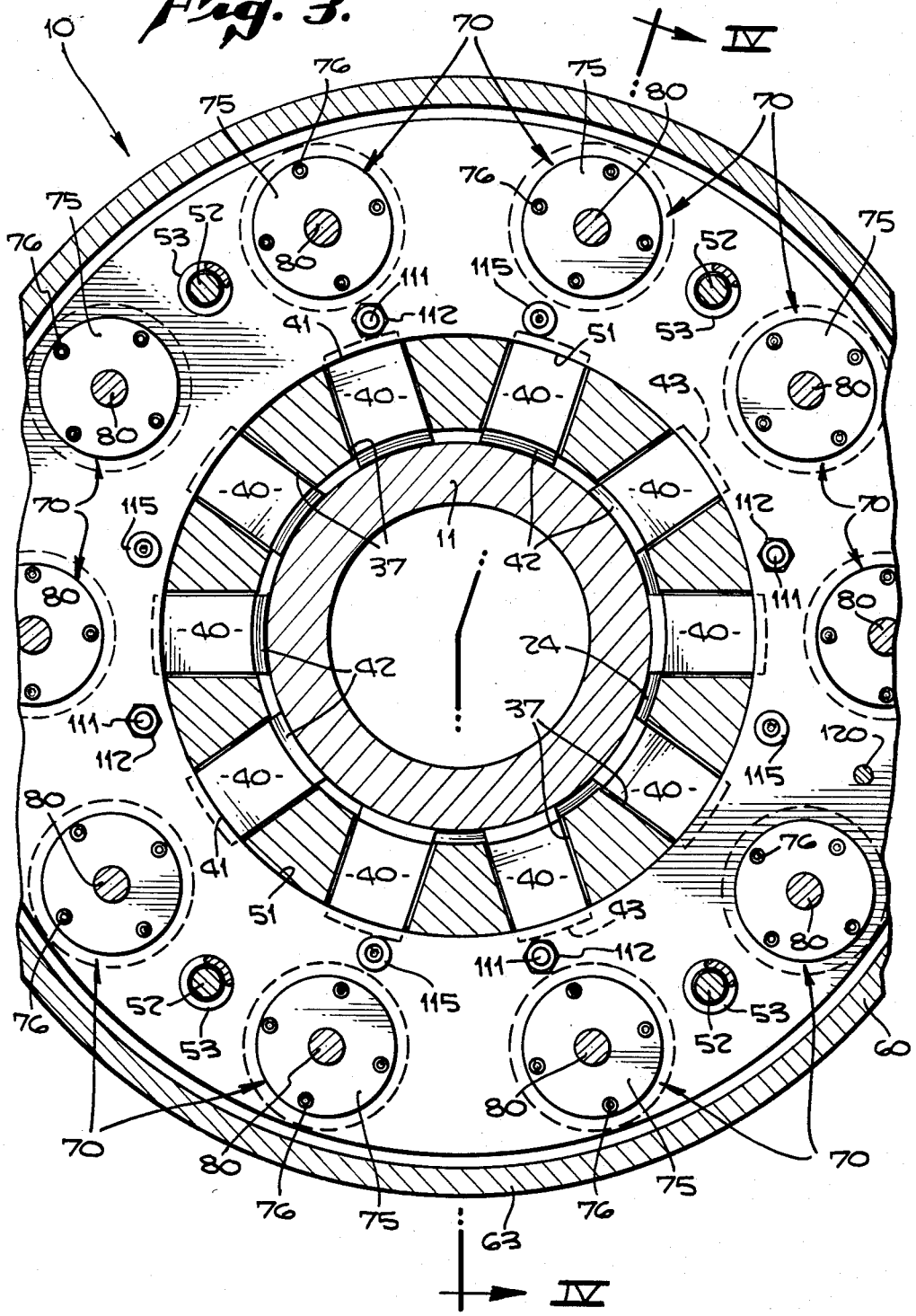
FIG. 3 is a horizontal section view of the marine conductor coupling of FIG. 2 taken therein along the plane III—III.

Referring now to FIGS. 2 and 3, the exemplary embodiment of marine conductor coupling, indicated generally at 10, as is particularly contemplated within the present invention, includes a one piece construction body 30 which is suitably drilled and tapped in its upper portions to receive a plurality of mounting studs, including studs 31 and 32, for securing the connector body 30 to the underside of the associated well head component, such as the bottom flange of the associated blowout preventer stack indicated generally at 19 (FIG. 1). Body 30 is provided with a mandrel receiving bore 33 in which is shown an exemplary well head apparatus associated mandrel 11. Bore 33 is chambered at its lower end to faciliate reception of mandrel 11. A metal seal 35 of known construction is positioned in the lower end of through bore 36 where it merges into the mandrel receiving bore 25. Seal 35 seals the connection between bores 25 and 36 when mandrel 11 is held securely within connector body 30 in abutting relation with seal ring 35 as discussed hereinafter. To faciliate assembly of seal 35 within body 30, the outer ring of seal 35 may be provided with an annular groove in which the end of a retainer bolt (not shown) may lodge, access to the bolt head of a retainer bolt which may pass horizontally through body 30 being afforded through access hole 37 in the outer housing, the hole 37 being seen in FIG. 5.

Figure 4:
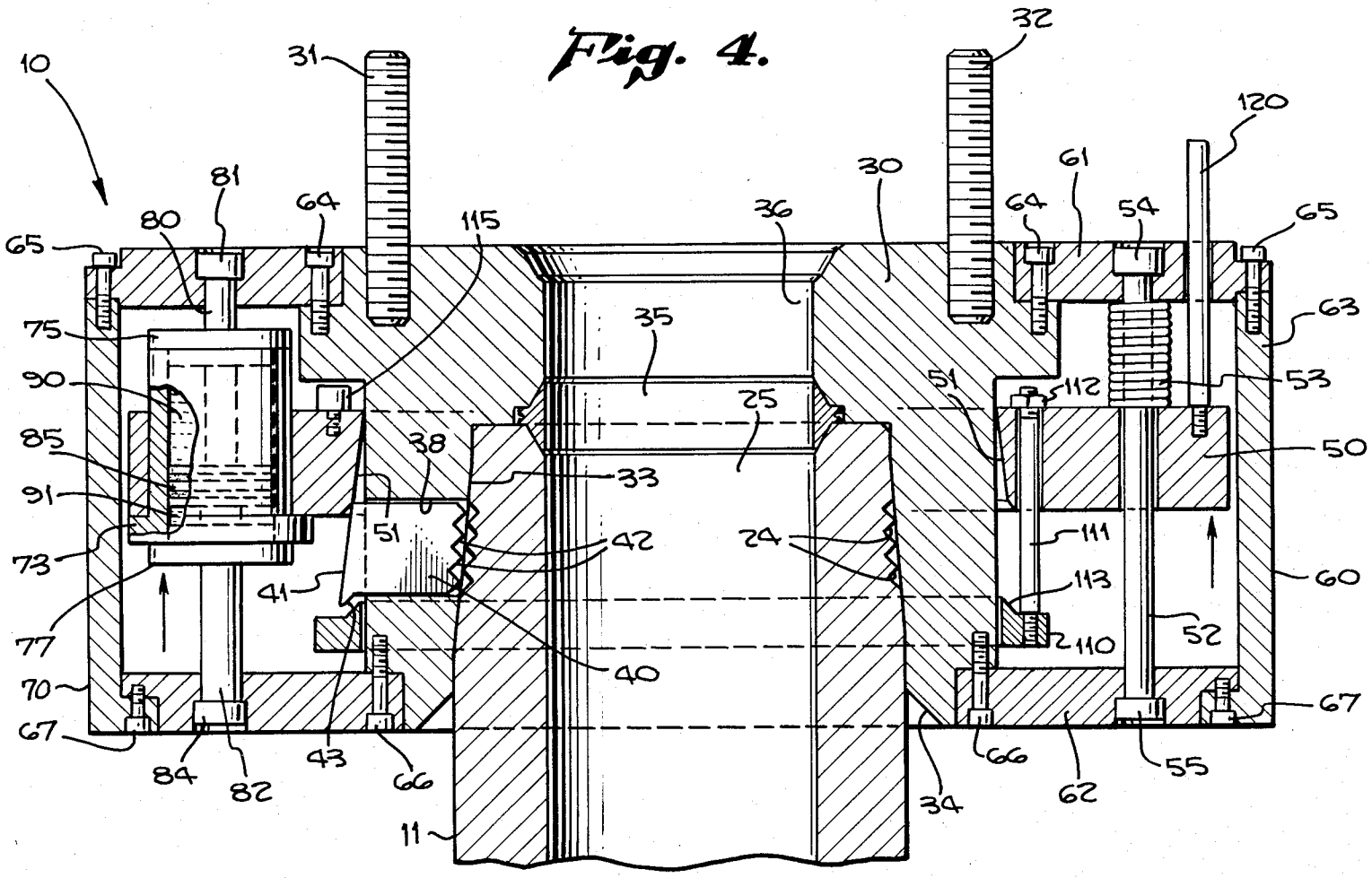
FIG. 4 is a view of the marine conductor coupling of FIG. 2 showing the latching dogs and associated hydraulic actuating means in a mandrel release position.

Latching means are provided in association with the marine conductor coupling body to hold the associated mandrel 11 securely within mandrel receiving bore 33 and, in the exemplary embodiment, comprise the provision of a plurality of locking dogs 40 having angled rear faces 41 to cooperate with an actuating ring described hereinafter. Each of the dogs 40 is provided with front face teeth 42 to mate with annular grooves 24 about the periphery of mandrel 11 adjacent its upper end. The individual latching dogs 40 are slidably mounted in slots 38 formed directly in the annular side wall of body 30, as seen in FIGS. 2 and 4, to place each of the dogs 40 in direct vertical load bearing relation to the one piece body 30. As will thus become apparent to those skilled in the art, from the foregoing description, any forces tending to separate the well head component to which body 30 is fastened by studs 31 from the well head associated mandrel 11 will be transmitted directly between mandrel 11 and the associated well head component through the dogs 40, one piece body 30 and studs 31. The flat to flat relationship between the flat bottom surfaces of dogs 40 and the flat bottom surfaces of slots 38 provides a even load distribution from dogs 40 to the one piece body 30, body 30 being connected directly by a plurality of fastening means, such as studs 31 to the associated component. Separation forces between the well head component to which the connector is mounted and mandrel 11 are thus placed through the strong, metallic one piece body 30 in a manner to prevent seal failures or undue wear over repeated use of the connector.

Actuating means are provided in the exemplary embodiment of marine conductor coupling for moving the plurality of latching dogs 40 into the mandrel latching position illustrated in FIG. 2. In the exemplary embodiment, such actuating means comprise the provision of actuator ring 50 having an angled inner face 51, formed by an inner conical bore of the ring. Rig face 51 is thereby adapted to wedge against the angled rear faces 41 of the individual dogs to wedge them into mandrel engaging position when ring 50 is forced in a downward direction in the environment of FIG. 2. Means are provided for mounting actuating ring 52 about the latch dogs 40 and, in the exemplary embodiment, include the provision of a plurality of mounting guide rods 52 secured to housing 60. As seen in FIG. 2, housing 60 includes a top annular flange 61, a bottom annular flange 62 and an annular vertical side wall 63 of generally cylindrical configuration. Appropriate fastening means are employed for holding the flanges to body 30, including upper bolts 64 and lower bolts 66, and to hold side wall 63 to the flanges including upper bolts 65 and lower bolts 67. The guide rods 52 mount biasing springs 53 between the upper flange 61 and the top of actuating ring 50 with rod end bolts, as bolts 54 and 55, holding the guide rods to the housing flanges, the bolts being countersunk in the flanges as seen in FIG. 2. Springs 53 are thereby adapted to normally bias actuating ring 50 in the downward direction in FIG. 2, tending to wedge ring 50 against the rear faces 41 of the latching dogs and thus urge the dogs into engagement with mandrel 11.

Figure 5:
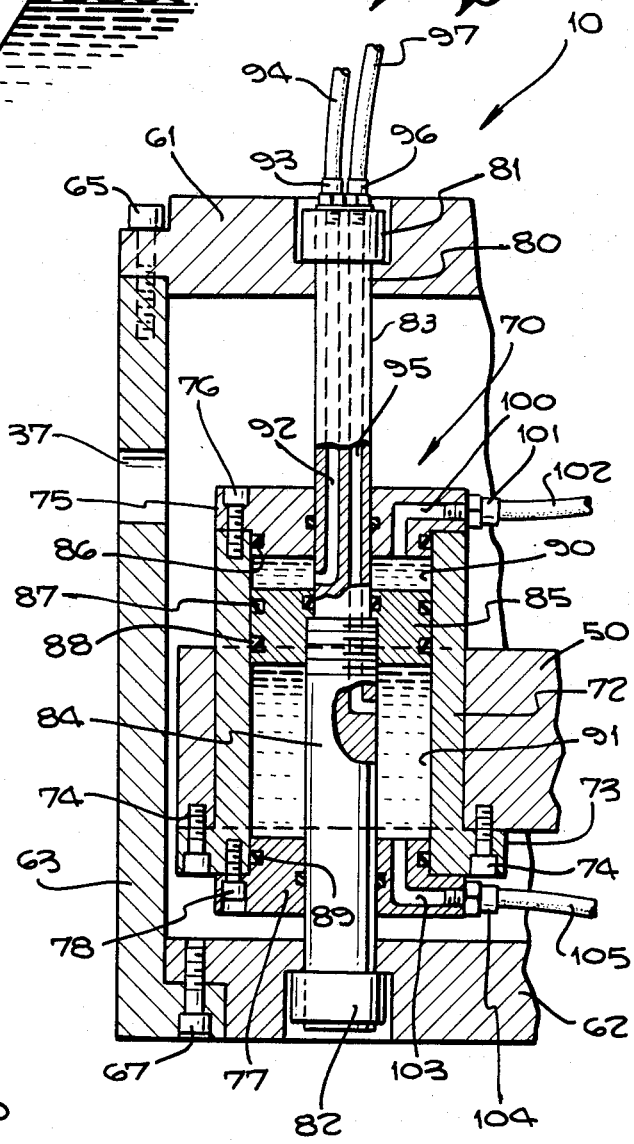
FIG. 5 is a detail view of the hydraulic actuating means of the exemplary embodiment of marine conductor coupling of FIGS. 1 through 4.

The actuating ring 50 is operated between the dog wedging position of FIG. 2 and the dog release position of FIG. 4 by hydraulic fluid operated means which, in the exemplary embodiment, comprise a plurality of hydraulic cylinder and piston means indicated generally at 70. As particularly contemplated within the present invention, and as will be described more completely hereinafter, the cylinders of the piston and cylinder means indicated generally at 70 are secured to the actuating ring for movement in unison therewith while the various piston rods 80 are secured to housing 60 in stationary relation to body 30. As best seen in FIGS. 2, 4 and 5, each of the hydraulic cylinder and piston means, indicated generally at 70, includes a cylinder housing 71 which includes a generally cylindrical side wall 72 having a bottom outwardly extending flange 73. Each cylinder is mounted by appropriate fastening means, such as bolts 74 through flange 73, to actuating ring 50. The top end of each cylinder is provided with a top end plate 75 secured to the cylinder side wall by bolts 76. Bottom end plates 77 are secured to the bottom end of the cylinder side walls by bolts 78. The top and bottom end plates are ported to receive the piston rod 80 therethrough with end bolts, 81 and 82, holding the double ended piston rod securely in the countersunk bolt receiving apertures provided in the end plates as best seen in FIG. 5. Preferably, the upper rod end portion 83 is provided with a first given diameter and the lower rod end portion 84 having a larger diameter whereby the effective pressure surfaces on piston 85 are of larger area on the upper surface of the piston then on the bottom to insure a greater dog release pressure on the cylinders and actuating rings, for a given amount of available hydraulic fluid pressure, than would be exerted in wedging the dogs into engagement with the mandrel 11. Each of the pistons 85 is held securely to the central portion of the piston rod and are stationary relative to the surrounding housing and associated body 30. O-ring seals 86, 87, 88, and 89 are provided to seal an upper piston chamber 90 and a lower piston chamber 91 within each of the cylinder housing 71. From the foregoing, it can be seen that the introduction of hydraulic fluid in chamber 90 will cause each of the cylinders 71 to raise and thus lift actuating ring 50 upperly in FIGS. 2 and 4 releasing dogs 40. For any given hydraulic fluid pressure available, the larger pressure area provided on the top surface of piston 85, due to the smaller diameter of rod end portion 83 compared to rod end portion 84, there will always be a greater release force then latching force. Introduction of hydraulic fluid into chamber 90 will cause the individual cylinder housings 71 and associated actuating ring 50 to descend in FIGS. 2, 4 and 5 to engage and wedge the latching dogs against mandrel 11 when the latter is positioned within bore 33.

Hydraulic fluid flow means are provided for supplying hydraulic fluid to each of the chambers 90 and 91 of the plurality of hydraulic cylinder housing 71. As is also contemplated within the present invention, such hydraulic fluid flow means provide for an interconnection of each of the upper chambers 90 to one another and each of the lower chambers 91 to each other with hydraulic fluid being selectively supplied from a remote location to one of the upper chambers 90 and to one of the lower chambers 91, the hydraulic fluid pressures in all of the upper chambers balancing, and the pressure in all of the lower chambers balancing, by virtue of their interconnection with one another as will now be described.

Referring to FIG. 5, hydraulic fluid inlet passage 92 is provided in one of the piston rods 80 associated with one of the cylinder housings 71 to communicate with the upper chamber 90 of that cylinder housing. An appropriate fitting 93 may be provided for connection to a conduit 94 run to the remote platform or floating vessel, as vessel 15 in FIG. 1. Hydraulic fluid inlet passage 95 is also provided in one piston rod 80 for one of the cylinder housings 71 to allow introduction of hydraulic fluid into one lower cylinder housing chamber 91. A suitable fitting 96 and associated line 97 are provided so that hydraulic fluid can be selectively introducted into chambers 90 and 91 from a remote, above sea location. Chamber 90 of the cylinder 71 of FIG. 5 is connected by outlet passage 100, fitting 101 and line 102 to each of the other cylinder housings 71 of the connector, the respectively interconnecting lines composing a manifold means for balancing the fluid pressure in all chambers 90 of the respective cylinder housings 71. Similarly, chamber 91 of the cylinder housing 71 of FIG. 5 is connected by outlet line 103, fitting 104 and hydraulic line 105 to each of the other chambers 91 of the other cylinder housings 71, such lines 105, fittings 104 and associated passages 103 in the other cylinder housings together comprising manifold means for maintain an equalized hydraulic fluid pressure in all of the chambers 91 of all of the cylinder housings 71. A uniform hydraulic pressure is thus exerted by all of the cylinder housings in a vertical upward or vertical downward direction, depending upon the selective application of hydraulic fluid to chambers 90 or 91.

Dog release means are provided in accordance with present invention to faciliate the release of the individual latching dogs 40 from mandrel 11 in association with movement of actuating ring 50 from the position of FIG. 2 to that of FIG. 4. In the exemplary embodiment, such dog release means includes the provision of a kick-out ring 110 which is mounted by guide rods 111 in a lost motion connection to ring 50. As seen in FIGS. 2 and 4, rods 111 are fitted through oversize holes in ring 50 and held thereto by end bolts 112. A limited amount of free movement between ring 50 and ring 110 is thus provided to allow an initial vertical movement of ring 50 before its picks up and carries knock-out ring 110 vertically therewith. Knock-out ring 110 has an upstanding annular wedging rim 113 adjacent inner marginal areas of the top surface thereof which underlie the rear ends of dogs 40. As can be seen from a comparison of the positioning of knock-out ring 110 in FIGS. 2 and 4, ring 110 having been lifted by actuating ring 50 with the actuating ring approaching the upper limits of its travel, which is limited by stops 115 abutting the overhead shoulder of body 30, in FIG. 4. Dogs 40 are shown backed out of engagement with the mandrel, the knock-out ring 110 causing an initial loosing of the dogs from the mandrel with separation of the mandrel from body 30 causing a camming action between dog teeth 42 and mandrel grooves 24 to move the dogs to a fully released position as seen in FIG. 4.

Indicator means are provided to indicate the raised position of actuator member 50 as seen in FIG. 4. In the exemplary embodiment, such indicating means include a vertical indicator rod 120 which is mounted to the upper side of actuator ring 50 and protrudes through a suitable aperture in housing top flange 61, as best seen in FIG. 4. When actuating ring 50 is in its lowered, dog wedging position of FIG. 2, the indicator rod 120 just barely protrudes from the upper housing flange 61 as seen in FIG. 2. There is thus a visually perceivable indication exteriorly of housing 60, by virtue of the positioning of indicator rod 120 correlated to the positioning of the actuator rod 50 within the housing and relative to the latching dogs 40. In a subsea well environment, the indicator rod position can be viewed by submersible television cameras located at the well site or perhaps by divers if such television equipment is not being used.

Having thus described an exemplary embodiment of marine conductor coupling in accordance with the present invention, it should now be apparent to those skilled in the art that the coupling of the within invention achieves the various objects and has the advantages therefor as discussed initially herein. The coupling has a low profile, allows for a high pressure connection and faciliates a metal-to-metal seal between subsea conduits. Forces tending to separate the connected conduits are transmitted directly through the one piece body of the connector in a high low bearing and reliable manner without affecting the metal-to-metal seal. A unique mounting of the actuator ring is provided with the double ended piston rods being stationary and the cylinders moving in unison to raise or lower the actuator ring in a uniform manner. Since the piston rods are secured to the body 30 via housing end flanges 61 and 62 in a stationary manner, the pistons are always placed in tension when hydraulic fluid is introduced into chambers 90 or 91 to cause movement of the actuator ring, the forces tending to push the fixed piston in the opposite direction thereby tensioning the associated piston rod. By providing different piston rod diameters in the respective upper and lower hydraulic fluid chambers within the cylinders, as described hereinbefore, a greater release force is assured on the actuator ring then was applied in wedging the dogs into mandrel latching position. The release of the latching dogs is also assured through the provision of the knock-out ring connected in its lost motion connection to the actuator ring. The angle provided between the rear faces of the latching dogs the actuating ring inner bore assure a positive latching of the dogs to the mandrels with the added provision of biasing springs to urge the actuating ring into the dog latching position with or without the presence of hydraulic fluid pressures within the cylinders. The manifold type connections between the cylinders assure an equalization of pressures between the various cylinder chambers to provide a uniform movement of the actuating ring on its guide rods. Indicator means provide a visual indication of the positioning of the actuating ring. Those skilled in the art should also appreciate that various other embodiments, adaptations, modifications and alternative constructions can be employed utilizing the invention of the within marine conductor coupling which is defined by the following claims.

I claim:

1. A marine conductor coupling for use in connecting a subsea well component with a well head associated member, said coupling comprising:

a connector body having a well head member receiving bore and a plurality of latch dogs mounted on said body for engagement with a well head member when the latter is positioned in said bore;

hydraulically actuated means for urging said dogs into a well head member latching position, said hydraulic actuating means comprising a plurality of double ended piston rods fixedly mounted relative to said body with a piston fixed in stationary relation on a midportion of each of said rods, a hydraulic cylinder positioned about each of said rods and its associated piston for vertical movement relative thereto, and seal means for sealing each said cylinder to its associated rod and piston, an actuating ring having a latch dog wedging face and being connected to said cylinders for movement therewith, and hydraulic fluid supply means for supplying hydraulic fluid to said cylinders selectively above and below said pistons to cause movement of said cylinders and associated actuating ring relative to said stationary rods and associated body so that said latch dog wedging face engages said latch dogs to urge said latch dogs into said well head member latching position.

2. The marine conductor coupling of claim 1 further comprising:

means for biasing said actuating ring and cylinders into a predetermined position wherein said ring wedges said latch dogs into said well head member latching position.

3. The marine conductor coupling of claim 1 further comprising:

knock-out ring means having a wedging face thereon to engage with said latch dogs to move them toward a well head member release position and means for moving said wedging face into engagement with said latch dogs when said actuating ring is moved by said hydraulic means to said well head member release position.

4. The marine conductor coupling of claim 3 wherein said means for mounting said knock-out ring means comprises a lost motion connection between said knock-out ring and said actuating ring.

5. A marine conductor coupling for use in connecting a subsea well component to a subsea well head associated member, said coupling comprising:

a connector body having a well head member receiving bore and a plurality of latch dogs mounted on said body for engagement with a well head member when the latter is positioned in bore;

hydraulically actuated means for urging said dogs selectively into and out of a well head member latching position, said hydraulic actuating means comprising a plurality of piston rods fixedly mounted relative to said body with a piston fixed in stationary relation to each of said rods, a hydraulic cylinder positioned about each of said rods and its associated piston for vertical movement relative thereto, and seal means for sealing each said cylinder to its associated rod and piston, an actuating ring having latch dog wedging faces and being connected to said cylinder for movement therewith, and hydraulic fluid supply means for supplying hydraulic fluid to said cylinders selectively above and below said pistons to cause movement of said cylinders and associated actuating ring relative to stationary rods and associated body so that said latch dog wedging faces engage said latch dogs to urge said latch dogs selectively into and out of said well head member latching position.

6. A marine conductor coupling for use in connecting a subsea well component with a well head associated member, said coupling comprising:

a connector body having a well head member receiving bore and a plurality of latch dogs mounted on said body for engagement with a well head member when the latter is positioned in said bore;

hydraulically actuated means for urging said dogs selectively into and out of a well head member latching position, said hydraulic actuating means comprising a plurality of double ended piston rods fixedly mounted relative to said body with a piston fixed in stationary relation on a midportion of each of said rods, a hydraulic cylinder positioned about each of said rods and its associated piston for vertical movement relative thereto, and seal means for sealing each said cylinder to its associated rod and piston, an actuating ring having a latch dog wedging face and being connected to said cylinders for movement therewith, a pair of hydraulic fluid passages extending into each rod, one having an outlet in said hydraulic cylinder below said piston and the other having an outlet in said hydraulic cylinder above said piston, and hydraulic fluid supply means for supplying hydraulic fluid to said hydraulic fluid passages selectively to cause movement of said cylinders and associated actuating ring relative to said stationary rods and associated body so that said latch dog wedging face engages said latch dogs to urge said latch dogs selectively into and out of said well head member latching position.

7. A marine conductor coupling for use in connecting a subsea well component with a well head associated member, said coupling comprising:

a connector body having a well head member receiving bore and a plurality of latch dogs mounted on said body for engagement with a well head member when the latter is positioned in said bore;

a plurality of double ended piston rods fixedly mounted relative to said body with a piston fixed in stationary relation on a midportion of each of said rods;

a hydraulic cylinder positioned about each of said rods and its associated piston for vertical movement relative thereto, and seal means for sealing each said cylinder to its associated rod and piston;

an actuating ring having a latch dog wedging face and being connected to said cylinders for movement therewith;

hydraulic fluid supply means for supplying hydraulic fluid to said cylinders selectively above and below said pistons to cause movement of said cylinders and associated actuating ring relative to said stationary rods and associated body so that said latch dog wedging face engages said latch dogs to urge said latch dogs selectively into an engaging position and into a release position; and each of said pistons having a greater pressure area on a side of said piston that moves said hydraulic cylinder and actuating ring toward said release position then the pressure area on the opposite side of said piston, to assure a greater release force than engaging force for the same hydraulic fluid pressure.

8. A marine conductor coupling for use in connecting a subsea well component to a subsea well head associated member, said coupling comprising:

a connector body having a well head member receiving bore and a plurality of latch dogs mounted on said body for engagement with a well head member when the latter is positioned in said bore;

an actuating ring carried in said body for vertical movement relative thereto the actuating ring having a latch dog wedging face for engaging and moving said latch dogs inwardly when said actuating ring is moved vertically between a retracted position in which said latch dogs are retracted to an engaged position in which said latch dogs engage said well head member;

hydraulic fluid means for selectively moving said actuating ring vertically between said positions; and latch dog knock-out means carried by said actuating ring for urging said latch dogs out of engagement with said well head member as said actuating ring moves toward the retracted position.

9. A marine conductor coupling for use in connecting a subsea well component to a subsea well head associated member, said coupling comprising:

a connector body having a well head member receiving bore and a plurality of latch dogs mounted on said body for engagement with a well head member when the latter is positioned in said bore;

an actuating ring carried in said body for vertical movement relative thereto, the actuating ring having a latch dog wedging face for engaging and moving said latch dogs inwardly from an upper retracted position in which said latch dogs are retracted to a lower engaged position in which said latch dogs engage said well head member;

hydraulic fluid means for selectively moving said actuating ring vertically between said positions;

an outwardly inclined depending lip on a rear lower end of each of said latch dogs; and an annular knock-out ring having an upstanding annular wedging rim about an inner marginal area of a top face of said knock-out ring for engaging the lips of said dogs, said knock-out ring being carried below said actuating ring by a plurality of rods which are rigidly secured to one of said rings and slidingly carried by the other of said rings, said rods having a length selected to begin moving said knock-out ring upwardly to engage and pull outwardly on said dogs only after said actuating ring has moved upward a selected distance.

* * * * *